United States Patent [19]

Tanaka et al.

[11] Patent Number: 4,494,924

[45] Date of Patent: Jan. 22, 1985

[54] FLAME DETECTOR FOR PULSE COMBUSTION APPARATUS

[75] Inventors: Toshio Tanaka, Toride; Motoshi Miyanaka; Shigekichi Kochiyama, both of Yanai, all of Japan

[73] Assignee: Hitachi, Ltd., Tokyo, Japan

[21] Appl. No.: 534,285

[22] Filed: Sep. 21, 1983

Related U.S. Application Data

[63] Continuation of Ser. No. 305,725, Sep. 25, 1981, abandoned.

[30] Foreign Application Priority Data

Aug. 24, 1981 [JP] Japan ..... 56-131517

[51] Int. Cl.[3] ..... F23N 5/12

[52] U.S. Cl. ..... 431/78; 431/1; 340/579

[58] Field of Search ..... 431/1, 78; 340/579; 324/57 R, 65 R; 331/66; 122/24; 60/39.76, 39.77, 247

[56] References Cited

U.S. PATENT DOCUMENTS 3,041,589 6/1962 Dietz ..... 340/579

4,080,149 3/1978 Wolfe ..... 431/1

*Primary Examiner*—Margaret A. Focarino

*Attorney, Agent, or Firm*—Antonelli, Terry & Wands

[57] ABSTRACT

A flame-rod type flame detecting apparatus for detecting flames produced intermittently in a pulse-like combustion process is disclosed. An oscillation circuit generates an A.C. flame detecting voltage to be applied across the flame to be detected. The A.C. voltage modulated by the flame provides a signal representative of the presence of flame. The frequency of the A.C. voltage is selected higher than the commercial line frequency and higher than a maximum frequency of the pulse-like intermittent combustion and selected such that the positive half-waves of the applied A.C. voltage are superposed on the flames produced intermittently, and more preferably at least one positive half-wave is superposed on each of the flames.

9 Claims, 4 Drawing Figures

FLAME DETECTOR FOR PULSE COMBUSTION APPARATUS

This is a continuation of application Ser. No. 305,725 filed Sept. 25, 1981, now abandoned.

BACKGROUND OF THE INVENTION

1. Field of the Invention

The present invention relates to a flame-rod type flame detecting apparatus for detecting flames in a pulse combustion apparatus.

2. Description of the Prior Art

With the terminology, "pulse combustion apparatus", it is intended to mean such a combustion apparatus in which flames are generated intermittently, i.e. in a pulse-like manner and which can thus be distinguished from a common combustion apparatus in which a flame of combustion is continuously present as time lapses. There are known various types of the pulse combustion apparatus. A typical one of the known apparatus comprises a valve for controlling supply of gaseous fuel and air to a combustion chamber and a discharging tube which is so designed as to produce columnar vibration (i.e. vibration of gas column) at a predetermined frequency in cooperation with the combustion chamber. In general, the combustion chamber and the discharging tube or conduit serve as a sort of a heat exchanger. In operation, a fuel-air mixture is supplied to the combustion chamber through the control valve and ignited by an ignitor to be combusted explosively. Under the pressure produced by the explosive combustion, the control valve is closed, while the gaseous combustion products are discharged by way of the exhaust or discharging pipe. Due to the discharge of the exhaust gas, a negative pressure (which means a pressure lower than that of the atmosphere) prevails in the combustion chamber, whereby the control valve is opened to suck the gaseous fuel and air into the combustion chamber. On the other hand, after-burning flame or a mass of high temperature gas present within the discharging conduit is returned to the combustion chamber under action of the columnar vibration produced through cooperation of the combustion chamber and the discharging conduit and serves as an igniting source for triggering the explosive combustion of the sucked fuel air mixture. Under the increased pressure involved by the explosive combustion, the combustion product gas is discharged. These various phases occur in one cycle which is repeated successively. In this way, the combustion takes place intermittently or in a pulse-like manner, so to say.

The frequency of the periodical pulse-like or intermittent combustion cycles lies usually within a range from 50 Hz to 80 Hz.

In connection with the combustion apparatus of the type described above, there are known various type of flame detectors for detecting the presence or absence of flames in the combustion apparatus. When flames are not in sodium yellow, and particularly in the case of the combustion apparatus for domestic use, a flame-rod type flame detecting apparatus is used. In the flame-rod type flame detector, an A.C. voltage is applied across a pair of electrodes which are disposed so as to contact with flames. When a flame is present, the A.C. voltage applied across the electrodes undergoes variations due to the rectifying action of the flame. Thus, the variations in the A.C. voltage can be taken out as a signal representing the presence or absence of flame. Detection of the presence of flame is effected during a positive half-wave period of the A.C. voltage.

Since flames produced in the pulse-like combustion apparatus described above is not in sodium yellow, the flame-rod type flame detecting apparatus described above may be used for detecting the presence or absence of flame. However, with the hitherto known flame-rod type flame detecting apparatus, the detection of flame can not be effected with a satisfactory accuracy and reliability, and often results in a failure to detect the presence or absence of flame.

As an attempt to overcome the difficulty of the rod-flame type flame detecting apparatus mentioned above, there has been proposed and used a pressure sensor type flame detector which is so designed as to detect the presence or absence of flame by detecting increase in pressure which results from the explosion brought about by the pulse-like combustion. However, the detector of this type is likely to suffer failures because a pressure sensor switch used has contact points. Further, erroneous operation is likely to take place when the combustion product gas is condensed within the pressure sensor switch, thereby deteriorating the reliability in operation.

For example, Japanese Utility Model Application Laid-open No. 123426/1979 filed Feb. 20, 1978 and laid open Aug. 29, 1979 discloses a circuit configuration of a flame-rod type flame detector circuit for detecting the presence of flame in a continuous combustion process. For the purpose of reference only, description will be made on the circuit configuration by referring to FIG. 1. In this figure, reference numeral 1 denotes a commercial A.C. power supply source to which an isolating transformer 2 having isolated primary and secondary windings is connected. The secondary winding of the transformer 2 is connected through a capacitor 3 to an electrode 4 which is adapted to be placed in a flame 5. A body of a burner or combustion apparatus 6 as well as the other end of the secondary winding is grounded. Numeral 7 denotes a load resistor. A smoothing circuit is constituted by resistors 8 and 9 and capacitors 10 and 11. The output of the smoothing circuit is coupled to a comparator 13 through a resistor bridge circuit generally denoted by 12 and constituted by resistors 15 to 18. A flame detection signal is derived at the output terminal 14 of the comparator 13 and is usually supplied to a combustion control circuit (not shown). Numeral 19 denotes a D.C. power supply source.

Description will be made as to the operation of the flame detecting apparatus of the structure described above. It is assumed at first that the flame 5 is absent. The electrode 4 is supplied with a voltage having a frequency of 50 Hz or 60 Hz from the commercial A.C. power supply 1 through the capacitor 3. Because the flame 5 is assumed to be absent, the A.C. voltage makes appearance across the resistor 7 without the waveform thereof being modified. Through the smoothing circuit constituted by the resistors 8 and 9 and the capacitors 10 and 11, the A.C. component of the voltage appearing across the resistor 7 is eliminated, resulting in that no D.C. component appears across the capacitor 11. In this connection, it should be noted that the values of the resistors 15, 16, 17 and 18 of the resistor bridge circuit 12 are so selected that the potential applied to the negative or minus input terminal of the comparator 13 is higher than the potential applied to the positive or plus input terminal thereof. As the consequence, a low level signal is produced at the output terminal 14 of the comparator 13. This low level signal thus represents the absence of flame.

Next, it is assumed that the flame 5 is present. In this case, the A.C. current supplied through the capacitor flows from the electrode 4 through the flame 5 and the burner 6 to the load resistor 7 as a rectified D.C. current due to the rectifying action of the flame 5. This D.C. current will be referred to as a detection current. As the consequence, there is produced a negative D.C. voltage component across the load resistor 7 in addition to the A.C. voltage component. When the voltage produced across the resistor 7 is smoothed by the smoothing circuit described above, a negative-going potential is produced across the capacitor 11 to lower the potential at the minus input terminal of the comparator 13. Thus, the potential at the minus input terminal of the comparator 13 is lowered below the potential at the positive or plus input terminal, so that the output signal appearing at the output terminal 14 of the comparator 13 is at a high level, representing the presence of the flame 5.

SUMMARY OF THE INVENTION

An object of the present invention is to provide a flame detector of the flame-rod type which is capable of detecting presence or absence of flame in a pulse combustion apparatus.

According to a general feature of the present invention, the flame detector is provided with an oscillation circuit which is adapted to produce an A.C. voltage with a higher frequency than that of the pulse-like combustion. The A.C. voltage thus produced is applied across a flame to be detected in such a manner that a positive half-wave of the A.C. voltage is adequately applied to the flame produced by each pulse-like combustion, so that the detection of flame of the pulse-like combustion can be accomplished with an significantly improved accuracy and reliability.

DETAILED DESCRIPTION OF THE PREFERRED EMBODIMENT

Figure 1:
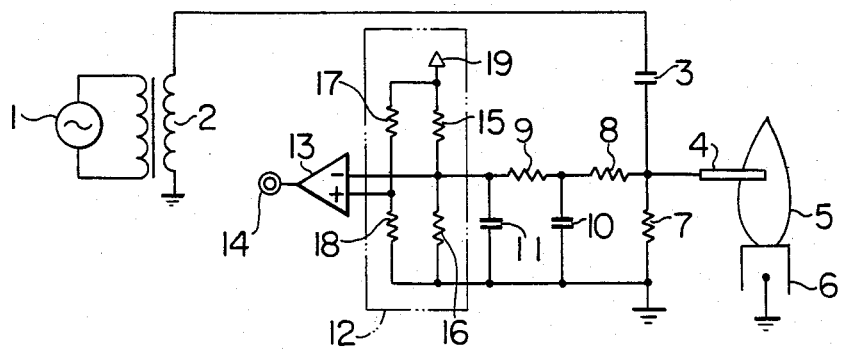
FIG. 1 PRIOR ART
FIG. 1 is a circuit diagram showing a circuit arrangement of a hitherto known flame-rod type flame detecting apparatus.

In the case where the hitherto known flame detector circuit described hereinbefore is used to a pulse combustion apparatus, the inventors have found that there is a drawback as follows: Since the A.C. voltage applied across the flame is derived directly from the commercial A.C. power supply of 50 or 60 Hz which approximates to the frequency (50 Hz to 80 Hz) of the pulse-like combustion and since no correlation is present in respect of phase between the commercial A.C. source voltage and the cycles of pulse-like combustion, there may arise a case in which the flame is produced during the negative half-wave cycle, involving a failed flame detection. More particularly, referring to FIG. 2, a waveform shown at A represents intermittent or pulse-like occurrence of flame. During a time interval corresponding to the high level of the waveform A, flame is present. Since the burning duration in one cycle can not be definitely determined, it is assumed that the burning duration is equal to the non-burning duration covering the expansion phase, discharge phase and the intake or suction phase. Waveforms of an A.C. voltage having a frequency approximating to that of the pulse-like combustion or burning cycle are shown at B and C in FIG. 2. In the case of the waveform shown at B, the positive half-wave (hereinafter referred to as the flame detecting voltage) of the A.C. voltage is in phase with the occurrence of flame, while in the case of the waveform shown at C in FIG. 2, the flame detecting voltage is out of phase by 180° and thus inversed in phase relative to the occurrence of flame. Since no definite correlation in phase exists between the A.C. voltage and the occurrence of flame, there may arise various phase relationships in addition to those shown in FIG. 2. In the case of the waveform B, the positive half-wave of the applied A.C. voltage can be applied to the flame (this situation will hereinafter be referred to as the superposition or superposed relation). Accordingly, the flame can be detected by means of the hitherto known flame-rod type flame detector described hereinbefore. However, in the case of the waveform of the applied A.C. voltage shown at C, the flame can not be detected by the known flame-rod type flame detector notwithstanding the presence of the flame, because no flame is present in the period of the positive half-wave of the applied A.C. voltage. When the frequency of the applied A.C. voltage is selected to be higher than the frequency of pulse-like combustion (e.g. in the case where the pulse-like burning takes place at a frequency of 50 Hz, while the applied A.C. voltage is 60 Hz), the superposed relation will be likely to occcur. However, superposition becomes inadequate due to deviation in phase, making it difficult or impossible to detect the presence of flame by the hitherto known flame-rod type flame detector device described above. When the frequency of occurrence of the pulse-like combustion flame is higher than that of the applied A.C. voltage, the superposed relation becomes more difficult to occur, leading to more frequent failed flame detections.

Figure 3:
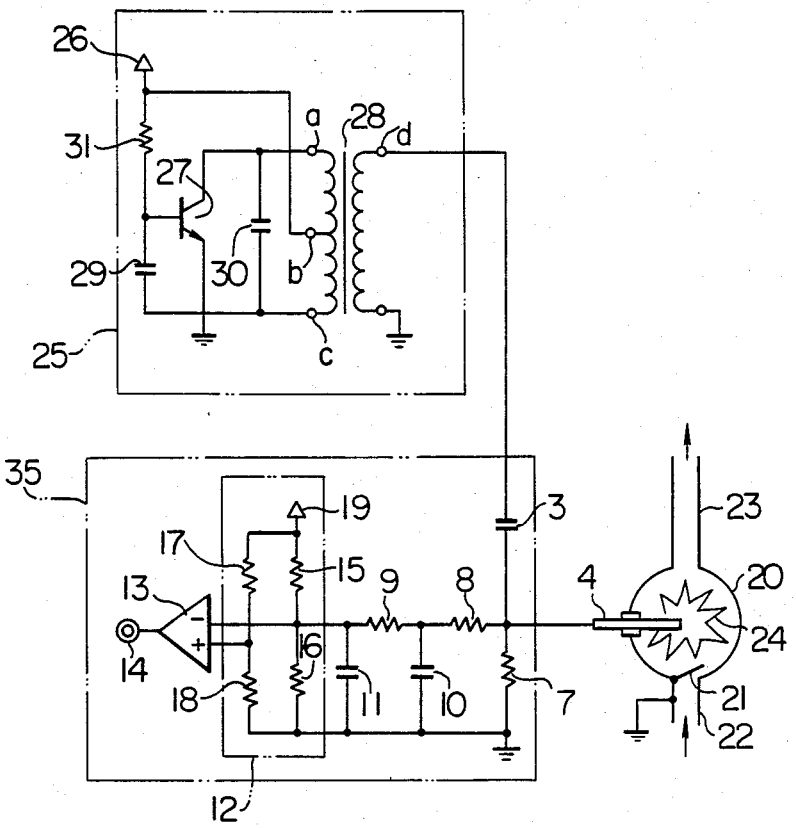
FIG. 3 is a circuit diagram showing a pulse-like combustion flame detecting apparatus according to an embodiment of the present invention.

In the following, the invention will be described in conjunction with an exemplary embodiment thereof shown in FIG. 3, in which same elements as those shown in FIG. 1 are denoted by same reference numerals. A combustion chamber 20 of a pulse combustion apparatus is provided with an inlet port 22 to which a fuel-air mixture is supplied through a valve 21. The combustion product gas is discharged through a discharge conduit 23. The combustion chamber 20 is grounded. Numeral 24 denotes a flame produced by the pulse-like or intermittent combustion. Numeral 25 denotes an oscillation circuit which is so designed as to produce a voltage of magnitude in the range of 50 to 150 V (volts) at a frequency of 200 Hz. The higher the applied A.C. voltage, the greater the corresponding increase in the flame detection current and, providing a more stabilized operation. The illustrated oscillation circuit 25 utilizes an inductance. Numeral 26 denotes a D.C. power supply source of 12 V, for example, and may be the same one as the D.C. source 19 and that of the combustion control circuit (not shown).

With the circuit arrrangement as illustrated, when a current of very small magnitude is fed to the collector of a transistor 27 of the oscillation circuit 25 due to the variation in voltage of the power supply source, the potential at a point a of a transformer 28 is lowered. At the same time, the potential at a point b tends to be correspondingly lowered. However, because the circuit point b is connected to the power supply source 26 so that the potential thereof is fixed, the potential at a point c located in opposition to the point b is increased so that the relation between the potentials at the circuit points a and b appears as the difference in potential between the circuit points b and c. The increase in potential at the circuit point c is transmitted to the base of the transistor 27 through a capacitor 29, causing the collector current to flow to the base, whereby the transistor 27 is instantly turned on. Subsequently, when the charge stored in a capacitor 30 is discharged through the transformer 28, the potential at the circuit point c begins to be progressively lowered. When this variation in potential at the point c is transmitted to the base of the transistor 27 through the capacitor, the transistor 27 is urged toward the off or non-conducting state, whereby the collector potential is increased to lower more the potential at the circuit point c and the base potential, to eventually make the transistor 27 to be completely off or blocked. Subsequently, the base potential of the transistor 27 is progressively increased at a rate determined by a time constant circuit composed of a resistor 31 and the capacitor 29.

When the base potential of the transistor 27 exceeds the base-emitter potential thereof, the transistor 27 begins again to be conductive, allowing a very small current to be fed to the collector. This corresponds to the start of the oscillation cycle described above. Thus, the oscillation is continuously repeated. A high A.C. voltage for flame detection is derived through the secondary winding of the transformer 28. The oscillation frequency and thus the frequency of the A.C. voltage is essentially determined by the capacitor 30 and the inductance provided by the transformer 28.

Figure 2:
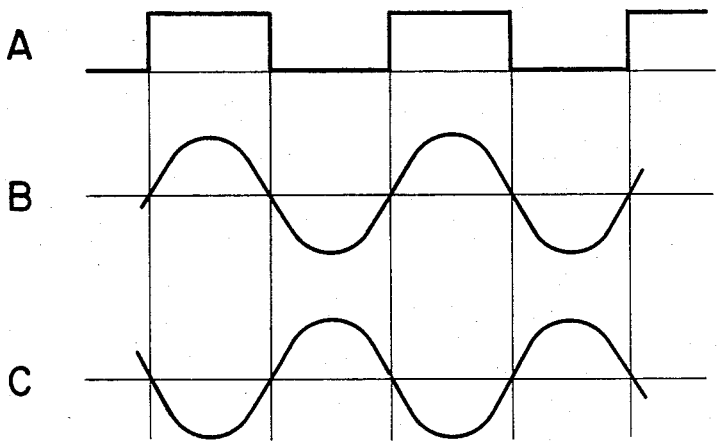
FIG. 2 is a waveform diagram illustrating relationship between pulse-like combustion flames and applied A.C. voltage signals.
Figure 4:
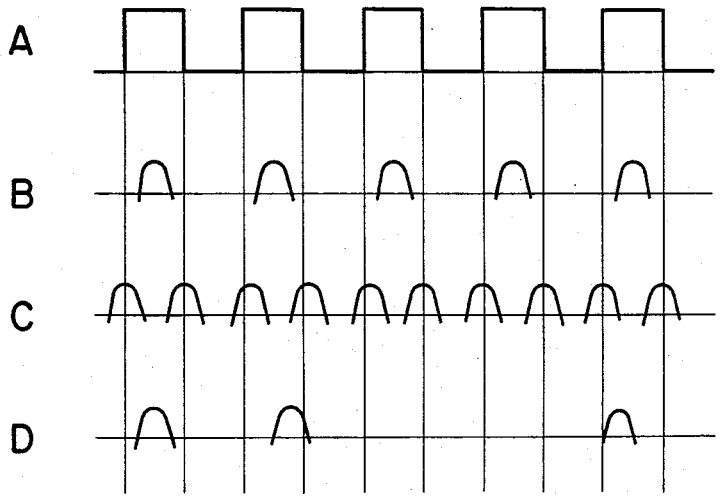
FIG. 4 is a waveform diagram to illustrate relationship between flames produced in pulse-like combustion and applied A.C. voltages.

FIG. 4 shows various waveforms in which the waveform A represents the occurrence of pulse-like flames in the same manner as the waveform A shown in FIG. 2, and in which the waveforms B, C and D show only portions which may be superposed on the durations of flames of the waveform A, of the applied A.C. voltages with different oscillation frequencies, while all the negative halves and the other portions of the positive halves are omitted therefrom. By selecting the oscillation frequency at an appropriate value sufficiently higher than the frequency of the pulse-like combustion, the duration of the individual flame will coincide in large part with the positive half-wave (i.e. flame detection voltage) of the applied A.C. voltage, to assure the detection of flame, as can be seen from relationship between the waveforms A and B or A and C shown in FIG. 4.

By way of example, it has been found that flame detection can be accomplished with a high accuracy when the oscillation frequency of the oscillator circuit 25 is selected at 200 Hz for the pulse-like combustion of the frequency in the range of 50 to 80 Hz.

Of course, the oscillation frequency may be selected higher in view of facility in designing the oscillation circuit 25. For example, oscillation frequency of 800 Hz may be selected. When the high oscillation frequency is selected, a plurality of the positive half-waves may be superposed to one and the same flame. The detection sensitivity of the flame detecting circuit 35 may be set in consideration of the selected oscillation frequency.

The foregoing description is based on the relationship between the oscillation frequency of the oscillation circuit 25 and the frequency of the pulse-like combustion. To make the description more detailed, it is necessary to consider additionally the relationship between the duration of flame and the duration of the flame detecting voltage in one cycle. However, because the duration of the flame is unknown to the inventors, such consideration will be omitted herein.

In the foregoing elucidation, it is assumed that the circuit is so designed that the individual flame detecting voltage pulses are superposed on the individual flames, respectively. However, it should be appreciated that the reliable detection of the presence of flame can be accomplished, even when defection of the detecting voltage pulses occurs sometimes, as is shown in FIG. 4 at D. More specifically, even when a succession of the superpositions is followed by several defections (two defections in the illustrated case) of superposition, the detection of the presence of flame can be assured by designing the flame detecting circuit 35 such that the increase in the input voltage to the minus terminal of the comparator 13 brought about by the defection of the superposition is prevented from going beyond the low level at which the signal representative of the absence of flame is outputted. This means that the oscillation frequency may be decreased correspondingly.

The circuit configuration of the oscillator circuit is not restricted to the one disclosed herein. The oscillator circuit may be constituted by using an astable multivibrator, a timer integrated circuit or the like. The transformer 28 may be constituted by a step-up transformer.

It will now be appreciated that the flame detecting voltage can be superposed to the flame produced by the pulse-like combustion, whereby a reliable and accurate flame detection can be accomplished.

We claim:

1. A flame detecting circuit for detecting flames produced intermittently in a pulse combustion apparatus, comprising a pair of terminals capable of being disposed to be in contact with flames produced intermittently as the result of pulse-like combustion in said combustion apparatus, a single A.C. voltage generating circuit for producing an A.C. voltage of a predetermined high frequency and of predetermined amplitude to be applied across said pair of terminals, and a flame detecting circuit of a rectifying system for producing a signal representative of presence or absence of said flame on the basis of an input signal which is produced across said pair of terminals through rectifying action of said flame when a period of occurrence of said flame is superposed on a period of a flame detecting voltage portion of said A.C. voltage, wherein said predetermined frequency is so selected that it is higher than that of a commercial A.C. power supply line and higher than a maximum value of frequencies of which said flames are produced in said pulse-like combustion, and that the period of at least one flame detecting voltage portion of said A.C. voltage is superposed onto the period of each of completely all the flames, and that in the case where a part of the flame detecting voltage portion of one cycle of said A.C. voltage and a part of the flame detecting voltage portion of succeeding one cycle of said A.C. voltage are superposed onto the period of one flame, the sum of periods of both the superpositions of said one and said succeeding one cycles of said A.C. voltage is not shorter than the entire period of the flame detecting voltage portion of one cycle of said A.C. voltage.

2. A pulse flame detector comprising means for enabling accurate detection of pulse flames produced intermittently in a pulse combustion apparatus, the pulse flame detection means including a pair of terminal means arranged for contacting pulse flames produced intermittently as a result of pulse-like combustion in the combustion apparatus, a single A.C. voltage generating circuit means for generating an A.C. voltage for application across the pair of terminal means, and pulse flame circuit means coupled to the pair of terminal means for producing a signal representative of presence or absence of the pulse flame in response to a detected value of one of a current and voltage signal produced across the pair of terminal means when a period of occurrence of the pulse flame is superposed on a period of a pulse flame detecting voltage portion of the A.C. voltage, the A.C. generating circuit means generating the A.C. voltage at a predetermined amplitude and at a predetermined high frequency which frequency is higher than a commercial A.C. power supply line frequency and higher than a maximum value of frequencies at which the pulse flames are produced in the pulse-like combustion for insuring that that period of at least one pulse flame detecting voltage portion is superposed onto the period of each of the pulse flames, whereby reliable and accurate detection of the occurrence of each pulse flame is enabled.

3. A pulse flame detector according to claim 2, wherein the A.C. generating circuit means generates the A.C. voltage at a frequency so that the entire period of the pulse flame detecting voltage portion of at least one cycle of the A.C. voltage is superposed onto the period of each pulse flame.

4. A pulse flame detector according to claim 3, wherein the A.C. generating circuit means generates the A.C. voltage at a frequency so that a plurality of pulse flame detecting voltage portions are superposed onto the period of each pulse flame.

5. A pulse flame detector according to claim 2, wherein the pulse flame detecting voltage portion of the A.C. voltage is a positive half wave of one cycle of the A.C. voltage, and the A.C. generating circuit means generates the A.C. voltage so that the positive half wave of the A.C. voltage is superposed onto the period of each pulse flame.

6. A flame detector according to claim 2, wherein the pulse combustion apparatus produces pulse flames at a maximum frequency of 80 Hz, and the A.C. generating circuit means generates the A.C. voltage at a frequency higher than 80 Hz.

7. A flame detector according to claim 6, wherein the A.C. generating circuit means generates the A.C. voltage at a frequency of at least 200 Hz.

8. A flame detector according to claim 7, wherein the A.C. generating circuit means generates the A.C. voltage at a frequency higher than 200 Hz.

9. A flame detector according to claim 8, wherein the A.C. generating means generates the A.C. voltage at a frequency of 800 Hz.

* * * * *